US012612849B1

(12) United States Patent
Chen et al.

(10) Patent No.: US 12,612,849 B1
(45) Date of Patent: Apr. 28, 2026

(54) METHOD FOR CONSTRUCTING HIGH-CONDUCTIVITY FRACTURE OF CARBONATE RESERVOIR STIMULATION

(71) Applicant: Southwest Petroleum University, Chengdu (CN)

(72) Inventors: Xiang Chen, Chengdu (CN); Zhaoxu Deng, Chengdu (CN); Pingli Liu, Chengdu (CN); Tianyu Zhang, Chengdu (CN); Yutong Yao, Chengdu (CN); Zhifeng Luo, Chengdu (CN); Nianyin Li, Chengdu (CN); Juan Du, Chengdu (CN); Jun Li, Chengdu (CN); Long Cheng, Chengdu (CN); Nanlin Zhang, Chengdu (CN); Fei Liu, Chengdu (CN); Chong Liang, Chengdu (CN); Yucheng Jia, Chengdu (CN); Chunmei Zou, Chengdu (CN); Yixin Chen, Chengdu (CN); Weijie Miao, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 19/369,530

(22) Filed: Oct. 27, 2025

(30) Foreign Application Priority Data

Oct. 27, 2024 (CN) ..... 202411504788.X

(51) Int. Cl.
*E21B 43/267* (2006.01)
*E21B 49/00* (2006.01)

(52) U.S. Cl.
CPC ..... *E21B 43/267* (2013.01); *E21B 49/00* (2013.01); *E21B 2200/20* (2020.05)

(58) Field of Classification Search
CPC ..... E21B 43/267
See application file for complete search history.

(56) References Cited

U.S. PATENT DOCUMENTS

2010/0132946 A1* 6/2010 Bell ..... E21B 43/117 166/298

FOREIGN PATENT DOCUMENTS

CN 105507870 A 4/2016
CN 112302604 A 2/2021
(Continued)

OTHER PUBLICATIONS

Li Ping, Li Ruiming, Liu Wei, Gao Yuan, Guo Yao, Wang Yao, Jia Peijuan; Research Progress on Wellbore Strengthening Technology at Home and Abroad,Western Exploration Engineering, Issue 09,Sep. 15, 2020, pp. 72-76.

(Continued)

*Primary Examiner* — William D Hutton, Jr.
*Assistant Examiner* — Avi T Skaist
(74) *Attorney, Agent, or Firm* — JEEN IP LAW, LLC

(57) ABSTRACT

The present application discloses a method for constructing a high-conductivity fracture of carbonate reservoir stimulation, and belongs to the field of oil and gas field stimulation. The method includes: S1. determining a lithology of a target layer, S2. preliminarily selecting a rock strengthening agent for in-situ modification of the fracture wall surfaces; S3. performing an experiment on in-situ modification of the fracture wall surfaces with the rock strengthening agent under a reservoir environment; S4. selecting the rock strengthening agent based on the experimental results; S5. constructing a mathematical model relating rock embedment strength to factors such as the rock strengthening agent; S6. constructing a mathematical model relating fracture conductivity to factors such as the rock embedment strength of the fracture wall surfaces; and S7. inversely designing parameters such as the rock strengthening agent based on the fracture conductivity required in the reservoir stimulation.

1 Claim, 1 Drawing Sheet

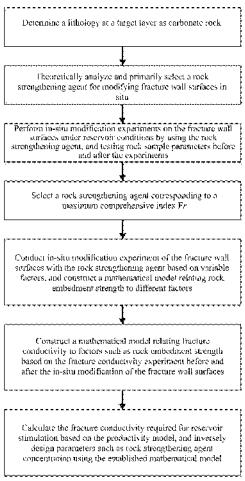

(56) References Cited

FOREIGN PATENT DOCUMENTS

| | | | |
|---|---|---|---|
| CN | 113417616 | A | 9/2021 |
| CN | 117605454 | A | 2/2024 |
| CN | 118261075 | A | 6/2024 |
| CN | 118669110 | A | 9/2024 |

OTHER PUBLICATIONS

Mou Jianye, Zhang Shicheng; Analysis of Factors Affecting Conductivity of Acid Fracturing Fractures,Oil and Gas Geology and Recovery, Issue 02,Mar. 25, 2011, pp. 73-75+83+119.

* cited by examiner

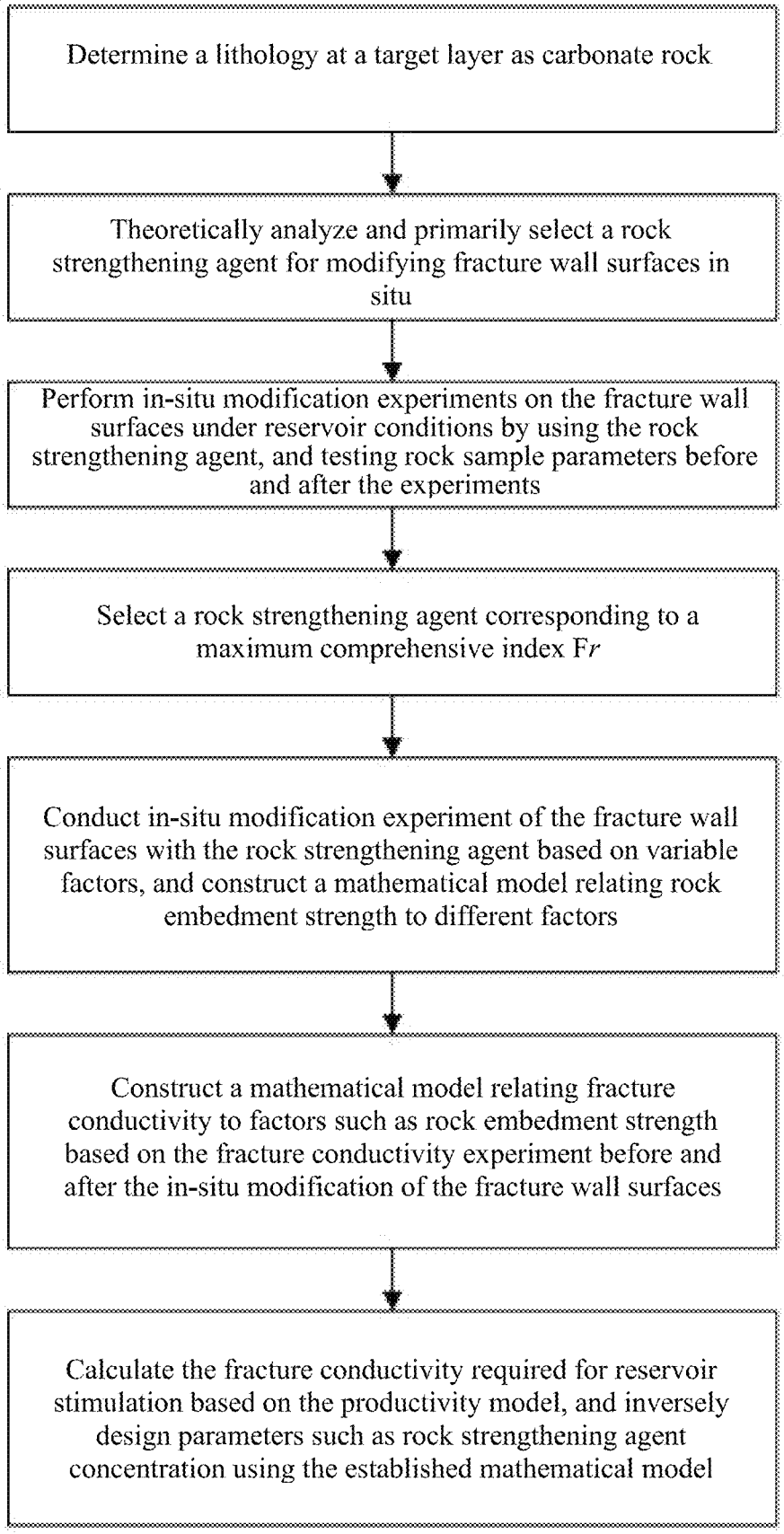
Determine a lithology at a target layer as carbonate rock
Theoretically analyze and primarily select a rock strengthening agent for modifying fracture wall surfaces in situ
Perform in-situ modification experiments on the fracture wall surfaces under reservoir conditions by using the rock strengthening agent, and testing rock sample parameters before and after the experiments
Select a rock strengthening agent corresponding to a maximum comprehensive index Fr
Conduct in-situ modification experiment of the fracture wall surfaces with the rock strengthening agent based on variable factors, and construct a mathematical model relating rock embedment strength to different factors
Construct a mathematical model relating fracture conductivity to factors such as rock embedment strength based on the fracture conductivity experiment before and after the in-situ modification of the fracture wall surfaces
Calculate the fracture conductivity required for reservoir stimulation based on the productivity model, and inversely design parameters such as rock strengthening agent concentration using the established mathematical model

METHOD FOR CONSTRUCTING HIGH-CONDUCTIVITY FRACTURE OF CARBONATE RESERVOIR STIMULATION

CROSS-REFERENCE TO RELATED APPLICATIONS

This application claims priority to Chinese Patent Application No. 202411504788.X, filed on Oct. 27, 2024, which is hereby incorporated by reference in its entirety.

TECHNICAL FIELD

The present application relates to fracturing or acid fracturing stimulation technology in the process of oil and gas field development, in particular to a method for constructing a high-conductivity fracture of carbonate reservoir stimulation, and belongs to the field of oil and gas field stimulation.

BACKGROUND

Carbonate oil and gas reserves account for approximately 70% of the total global oil and gas reserves, and carbonate oil and gas production accounts for approximately 60% of the total global oil and gas production. Carbonate oil and gas reservoirs are the main force of oil and gas reserves and production, and have broad development prospects. Deep and ultra-deep carbonate oil and gas reservoirs have gradually become the replacement zones for oil and gas production. In addition, carbonate rock is a typical lithology, and carbonate reservoirs have extremely abundant geothermal resources. Hydraulic fracturing and acid fracturing technologies are essential means for stimulation of carbonate geothermal and oil and gas reservoirs, and the fracture conductivity determines the stimulation effect. The characteristics of deep and ultra-deep carbonate reservoirs, such as ultra-high temperature, ultra-high pressure, and ultra-high closure stress, result in low fracture conductivity, which severely affects the stimulation effect.

Existing studies have shown that geological factors (such as reservoir temperature, fracture closure stress, and rock embedment strength) and engineering factors (such as proppant type and concentration, acid type and concentration, injection volume, and displacement) determine the level of fracture conductivity. For the acid fracturing, there are currently two methods to enhance fracture conductivity: one method is to create strong non-uniform etching on the fracture surfaces, implemented by acid selection, optimization of injection parameters, and multi-stage alternating injection; the other method is to prop the acid-etched fractures with proppant, implemented by composite acid fracturing with proppant. For the hydraulic fracturing, the current methods to enhance fracture conductivity mainly rely on propping the hydraulic fractures with proppant, implemented by proppant selection and optimization of proppant placement concentration and method. These methods all focus on the engineering factors affecting fracture conductivity and have been well developed. The resulting fractures exhibit high conductivity under low closure stress, but the conductivity of the fractures decreases rapidly with increasing closure stress, and becomes extremely low under high closure stress. Therefore, based on the mechanism of conductivity reduction, the present application addresses the geological factors affecting conductivity, and maintains high conductivity of acid-etched fractures or proppant-filled fractures under high closure stress by in-situ modification of the mechanical properties of the fracture wall surfaces.

The inventors have found that the Chinese Patent Application No. CN117605454A discloses a novel method for enhancing fracture conductivity in carbonate reservoir stimulation. The principle for improving fracture conductivity is chemical strengthening of the fracture surface rock. Specifically, the method first determines a series of potential chemical agents through theoretical analysis (step S2), and then screens the chemical agents of S2 in sequence through laboratory experiments, where chemical agents are screened with the goal of enhancing fracture surface rock strength (step S3), chemical agents are screened with the goal of minimizing damage to fracture surface rock permeability (step S4), chemical agents are screened with the goal of rapidly completing the fracture surface rock strengthening (step S5), and chemical agents are screened with the goal of maximizing fracture conductivity (step S6). This stepwise preferential screening method may result in missing chemical agents that provide moderate to high enhancement of rock strength while having minimal damage to rock permeability and rapidly strengthening the fracture surface rock; that is, the sequential order of stepwise selection affects which chemical agent is ultimately determined. Moreover, this method does not consider the penetration depth of the chemical agent into the rock, that is, how deeply the rock can be strengthened. In addition, this method does not take into account the actual requirements for fracture conductivity enhancement in different reservoirs, and consequently, the resulting fracture conductivity may be excessively high, leading to waste. A design method based on this novel principle for improving fracture conductivity has not been established. The Nierode-Kruk relationship is a classic formula for calculating the conductivity of acid-etched fractures, in which the fracture conductivity is closely and positively correlated with rock embedment strength (Li Yingchuan, Zhong Haiquan. *Petroleum Production Engineering* (3rd Edition, Rich Media) [M]. Petroleum Industry Press, 2021:327-328; Wang Yufang, et al. Study on the Variation of Carbonate Acid Fracture Conductivity with Fracture Length [J]. *Journal of Geomechanics,* 2015, 21 (04): 546-554). However, a method for calculating rock embedment strength has not yet been established.

SUMMARY

Aiming at the defects in the prior art, an objective of the present application is to provide a method for constructing a high-conductivity fracture of carbonate reservoir stimulation. The specific technical solution includes the following steps S1 to S8.

In step S1, a lithology at a target formation is determined to be carbonate rock. The lithology and specific mineral composition of rock samples at the target formation are analyzed using testing means such as an X-ray fluorescence spectrometer, an X-ray diffractometer, a nuclear magnetic resonance spectrometer, an electron probe microanalyzer, and a scanning electron microscope.

In step S2, a theoretical analysis is performed and rock strengthening agents for in-situ modification of fracture wall surfaces are preliminarily selected. Based on the fundamental concepts of diagenesis and dolomitization theory in geology, a theoretical analysis is performed on the rock strengthening agents capable of directly cementing rock particles and in-situ converting carbonate minerals. According to the requirement that the rock strengthening agents may be easily injected into fractures of the underground target formation, a series of rock strengthening agents are preliminarily selected.

In step S3, in-situ modification experiments on fracture wall surfaces are performed under reservoir conditions by using the rock strengthening agents preliminarily selected in step S2, and parameters such as rock sample hardness, permeability, mass, and three-dimensional spatial distribution of pores before and after the experiments are tested. In an experimental platform simulating a real reservoir environment, in which the rock strengthening agents react or consolidate with the fracture wall surface rocks and filtrate through the fracture wall surfaces, experiments for in-situ modification of fracture wall surfaces by the rock strengthening agents are performed. The permeability, hardness, three-dimensional spatial distribution of pores reconstructed by CT, and mass of the rock samples before and after treatment with the rock strengthening agents are respectively tested using a permeability tester, a micro-Vickers hardness tester, a rock CT scanner, and an analytical balance.

In step S4, based on the experimental results of step S3, a rock strengthening agent corresponding to a maximum comprehensive index is selected. A calculation formula of a comprehensive index $F_r$ is as follows:

$$F_r = x\frac{HV_s - HV_o}{HV_o} + \gamma\frac{k_s - k_o}{k_o} + \xi\frac{L_s - \Delta L}{L_s} + \lambda\frac{(m_z - m_o)/t}{\frac{1}{n}\sum_{i=i}^{n}[(m_{si} - m_{oi})/t_i]} \quad (1)$$

where $HV_s$, $K_s$, $L_s$, $m_z$, and $t_i$ respectively represent hardness, permeability, length, mass, and treatment time of the rock sample after treatment with the rock strengthening agent; the subscript i represents an i-th experiment, each rock strengthening agent is tested n times; $HV_o$, $K_o$ and $m_o$ respectively represent hardness, permeability, and mass of an original rock sample; $\Delta L$ is a penetration depth of the rock strengthening agent, obtained from the three-dimensional spatial distribution of pores reconstructed by CT before and after the experiment; and $\chi$, $\gamma$, $\xi$, and $\lambda$ are coefficients, $\chi+\gamma+\xi+\lambda=1$.

In step S5, the in-situ modification experiments on fracture wall surfaces are performed using the rock strengthening agent selected in step S4 under different factors (surface-to-volume ratio, rock strengthening agent concentration, experimental temperature, pressure, and time), the rock sample hardness before and after the experiments is tested, a rock embedment strength before and after the experiments is calculated, and a mathematical model relating the rock embedment strength to the different factors is constructed. A calculation formula for rock embedment strength is as follows:

$$S_{RE} = \frac{gHV}{\sin\frac{\alpha}{2}} \times 10^6 \quad (2)$$

where $S_{RE}$ is the rock embedment strength; g is the acceleration of gravity; HV is the rock sample hardness; and $\alpha$ is a relative angle between an indenter of the hardness tester and the surface.

Based on the experimental result data, a clear mathematical model relating THE rock embedment strength to different factors is constructed using multivariate nonlinear regression, as follows:

$$S_{REs} = f\left(\frac{S}{V}, C_z, T, P, t, S_{REo}\right) \quad (3)$$

where $S_{REs}$ is the rock embedment strength of the rock sample after treatment with the rock strengthening agent;

$$\frac{S}{V}$$

is a ratio of a reaction area of the rock sample to a volume of the rock strengthening agent participating in the reaction; $C_z$ is a concentration of the rock strengthening agent; T, P, and t are experimental temperature, pressure, and time, respectively; and $S_{REo}$ is a rock embedment strength of the original rock sample.

In a case where multivariate nonlinear regression fails to fit a clear mathematical model due to strong nonlinearity in the data, 75% and 25% of the experimental result data are used as a training set and a test set, respectively, the data are standardized, and an association model between the different factors and the rock embedment strength after treatment with the rock strengthening agent is established based on machine learning algorithms such as Gaussian Process Regression (GPR), Random Forest (RF), and Artificial Neural Network (ANN), model training, testing, and optimization are performed, and a final model is selected according to evaluation metrics (such as mean absolute error (MAE) and root mean square error (RMSE)).

In step S6, the experiments on the fracture conductivity before and after in-situ modification of fracture wall surfaces are performed using the rock strengthening agent selected in step S4, morphological characteristic parameters and rock embedment strength of the fracture wall surfaces before and after modification are obtained, and a mathematical model relating the fracture conductivity to the rock embedment strength of the fracture wall surfaces, fracture morphology, proppant parameters, proppant placement concentration, and effective closure stress is constructed. The morphology of the fracture wall surface is obtained using laser scanning, the morphological characteristic parameters of the fracture wall surfaces are calculated, and a root mean square elevation is as follows:

$$Ra = \sqrt{\frac{1}{M_x M_y - 1}\sum_{j=1}^{M_x}\sum_{k=1}^{M_y}(z(x_j, y_k) - z_a)^2} \quad (4)$$

where Ra is the root mean square elevation; $M_x$ and $M_y$ are numbers of data points on a rock plate surface along X-axis or Y-axis; $z(x_j, y_k)$ is a data point at x=j, y=k; and $z_a$ is a mean elevation.

Roughness Coefficient:

$$JRC = 85.2671(D-1)^{0.5679} \quad (5)$$

where JRC is the roughness coefficient, and D is a fractal dimension of a fracture profile.

Transverse and Longitudinal Tortuosity Ratios:

$$\begin{cases} \varepsilon_a = \dfrac{\sum_{k=0}^{M_y} L_{cc(y=k)}}{M_x M_y \Delta L_x} \\ \varepsilon_d = \dfrac{\sum_{j=0}^{M_x} L_{d(x=j)}}{M_x M_y \Delta L_y} \end{cases} \quad (6)$$

where $\varepsilon_{cc}$ and $\varepsilon_{cl}$ are the transverse and longitudinal tortuosity ratios, respectively; $L_{cc}$ and $L_{cl}$ are transverse and longitudinal profile curve lengths, respectively; $\Delta L_x$ and $\Delta L_y$ are transverse and longitudinal scanning steps, respectively.

Based on fracture conductivity experimental result data, a mathematical model relating the fracture conductivity to the rock embedment strength of the fracture wall surfaces, fracture morphology, the proppant parameters, the proppant placement concentration, and the effective closure stress is constructed by multivariate nonlinear regression, namely:

$$kwf=F(S_{RE2}, Ra, JRC, \varepsilon_{cc}; \varepsilon_{cl}, \phi_p, C_p, \sigma_{ce}) \quad (7)$$

where kwf is the fracture conductivity; $\phi_p$ is a porosity of the proppant placed within the fracture; $C_p$ is proppant placement concentration; and $\sigma_{ce}$ is the effective closure stress of the fracture.

In a case where a clear mathematical model cannot be fitted by the multivariate nonlinear regression method due to the strong nonlinearity of the data, 75% and 25% of the experimental result data are respectively used as a training set and a testing set, the data are subjected to standardization processing, a correlation model between the fracture conductivity and the rock embedment strength of the fracture wall surfaces, the fracture morphology, the proppant parameters, the proppant placement concentration, and the effective closure stress is established based on machine learning algorithms (such as GPR, RF, and ANN), model training, testing, and optimization are performed, and a final model is selected according to evaluation indicators (such as MAE and RMSE).

In step S7, a production capacity model based on the coupling of seepage flow (matrix), fracture flow (fracture), and free flow (cavity) is used to calculate the fracture conductivity to be achieved by the carbonate reservoir stimulation; and combined with reservoir parameters and fracture closure time, the concentration of the rock strengthening agent, the fracture morphology, the proppant parameters, and the proppant placement concentration are inverted and designed using the mathematical models established in steps S6 and S5. A production capacity-fracture conductivity curve is calculated and plotted by using the production capacity model, and the fracture conductivity corresponding to the inflection point where production capacity changes from rapid growth to slow growth is determined. The fracture closure time is calculated by the fracture closure model.

In the foregoing calculation methods, the meanings of identical symbols appearing in all formulas are consistent throughout, and once a symbol is defined, the same definition applies universally.

The flow process for constructing a high-conductivity fracture disclosed in the present application is shown in FIG. 1.

The present application adopts a comprehensive index $F_r$ for simultaneous evaluation, overcomes the problem caused by the sequential order of stepwise selection in Patent CN117605454A, and additionally introduces the rock strengthening agent penetration depth $\Delta L$ as a key parameter into consideration. The present application determines the required fracture conductivity corresponding to different reservoir stimulation, and subsequently performs inverse design of the rock strengthening agent concentration, fracture morphology, proppant parameters, and proppant placement concentration by using the mathematical models established in steps S5 and S6 to, thereby forming a definite design method. The present application provides a specific calculation formula for calculating rock embedment strength based on rock hardness and constructs mathematical models of fracture conductivity versus various influencing factors (step S6) and rock embedment strength versus various influencing factors (step S5) through multivariate nonlinear regression or machine learning.

The present application has the following beneficial effects: The required fracture conductivity for reservoir stimulation is determined based on the productivity model, and parameters such as rock strengthening agent are designed through the mathematical models constructed from indoor experimental results, thereby constructing fracture conductivity that meets the reservoir stimulation requirement. The rock strengthening agent is used for in-situ modification of the rock mechanical properties at the fracture wall surfaces, which reduces the embedding, crushing, and deformation of the fracture wall surfaces, and enables the fracture to maintain high conductivity under high closure stress, thereby achieving improved performance.

Additional advantages, objectives and features of the present application will be embodied in part through the following description, and in part will be understood by those skilled in the art through study and practice of the present application.

BRIEF DESCRIPTION OF THE DRAWINGS

FIG. 1 is a flow chart for constructing a high-conductivity fracture for carbonate reservoir stimulation.

DESCRIPTION OF EMBODIMENTS

The preferred embodiments of the present application are described below in conjunction with the accompanying drawings. It should be understood that the preferred embodiments described herein are only used to illustrate and explain the present application, and are not used to limit the present application.

In the present application, the term "surface-to-volume ratio" refers to the ratio of the surface area of the rock in contact with a unit volume of liquid to the volume of the liquid, where a larger surface-to-volume ratio corresponds to a faster reaction rate.

For the construction of a high-conductivity fracture in acid fracturing stimulation of a carbonate reservoir, the basic parameters are shown in Table 1, and the process is shown in FIG. 1.

TABLE 1

| Basic parameters (8013-8049 m) | | | |
|---|---|---|---|
| Parameter | Value | Parameter | Value |
| Reservoir mineral composition | 92.3% calcite + 5.9% dolomite + 1.6% quartz + 0.2% clay | Reservoir temperature | 182 ° C. |
| Reservoir type | Fracture-pore type | Reservoir pressure | 87 MPa |
| Natural fractures | Strike 15°, linear density 0.6 fractures/m, length 1.5 m | Acid fracturing fracture length | 150 m |
| Acid fracturing fracture width | 0.004 m | Acid fracturing fracture height | 37 m |
| Minimum horizontal principal stress | 143 MPa | Matrix permeability | $0.9 \times 10^{-3}$ $\mu m^2$ |
| Maximum horizontal principal stress | 161 MPa | Matrix porosity | 2.8% |
| Fluid viscosity | 18 mPa · s | Fluid density | 1060 $kg/m^3$ |
| Fluid bulk modulus | 10 GPa | Young's modulus | 46 GPa |
| Rock skeleton bulk modulus | 65 GPa | Poisson's ratio | 0.27 |
| Comprehensive compressibility coefficient | 3 $kPa^{-1}$ | Nozzle size | 1 mm |

In step S1, a lithology of a target formation (8013-8049 m) is tested and analyzed by an X-ray diffractometer and a scanning electron microscope, the lithology is determined as carbonate rock, and the main components are 92.3% calcite, 5.9% dolomite, 1.6% quartz, and 0.2% clay minerals.

In step S2, a theoretical analysis is performed to identify rock strengthening agents capable of cementing rock particles or in-situ converting calcite into harder minerals, and a preliminary selection of rock strengthening agents is made, including $(NH_4)_2HPO_4$, $Na_2HPO_4$, $K_2HPO_4$, $Si(OC_2H_5)_4$, $ZnSO_4$, $ZnCl_2$, $Zn(NO_3)_2$, NaF, $Na_2O{\cdot}nSiO_2$ and multistage ionizable weak acids ($H_3PO_4$, $C_4H_4O_4$), either individually or in pairwise combinations.

In step S3, under an experimental temperature of 182° C., a pressure of 87 MPa, and times of 0.1, 0.2, 0.5, 1, 2, 4, and 8 hours, in-situ modification experiments of fracture wall surfaces using rock strengthening agents are performed in a high-temperature and high-pressure autoclave. The permeability, hardness, mass, and CT-reconstructed pore spatial distribution of the rock samples before and after treatment with the rock strengthening agents are measured using a permeability tester, micro-Vickers hardness tester, analytical balance, and rock CT scanner, respectively. The steps of the in-situ modification experiment of the fracture wall surfaces using the rock strengthening agents are as follows: the experimental rock sample is placed in the autoclave, and the strengthening agent is placed in a storage tank; after heating to the experimental temperature, the valve of the storage tank is opened, and the strengthening agent is driven into the autoclave using high-pressure nitrogen; the valve is then closed, and a hydraulic pressurization system is activated to raise the pressure in the autoclave to the experimental pressure; after maintaining the reaction for a specified time, the heater is turned off and the pressure is released; the drain valve is opened to discharge the solution from the autoclave; after cooling to ambient temperature, the autoclave lid is removed, and the sample is taken. During the above reaction, the storage tank is sequentially connected to an intermediate piston container; one end of the intermediate piston container is connected to the storage tank, and the other end is connected to a high-pressure nitrogen cylinder, with a piston positioned in the middle of the intermediate container. The autoclave is also connected to a hydraulic pressurization device. The aforementioned devices and components are conventional in the field, and those skilled in the art can readily understand the connections among the components based on the above description.

In step S4, $\chi$, $\gamma$, $\xi$, and $\lambda$ are 0.58, 0.12, 0.09, and 0.21, respectively. n is 7. The comprehensive index $F_r$ reaches maximum when $Na_2HPO_4$ and $H_3PO_4$ are combined in a 30:1 ratio.

In step S5, based on the fracture size parameters (a fracture length 150 m, a fracture height 37 m, and fracture widths of 0.01, 0.007, 0.004, and 0.001 m), the surface-to-volume ratios are calculated as 100, 143, 250, and 1000. The concentrations of $Na_2HPO_4$+$H_3PO_4$ are 0.05, 0.1, 0.2, and 0.3 M, the experimental temperatures are 89, 120, 151, and 182° C., the pressures are 87, 115, 143, and 171 MPa, and the times are 0.1, 1, 2, and 4 h. Orthogonal in-situ modification experiments of fracture wall surfaces using $Na_2HPO_4$+$H_3PO_4$ are performed under different factors. The rock sample hardness before and after the experiments is measured using a micro-Vickers hardness tester, and the rock embedment strength before and after the experiments is calculated using formula (2). A model is initially fitted using multivariate nonlinear regression, but the residuals and variance (SSE) are too large. Therefore, a correlation model between the post-treatment rock embedment strength and the different factors is established using machine learning algorithms (GPR, RF, ANN). According to the evaluation metrics MAE and RMSE, the RF model is selected to describe the relationship between $S_{REs}$ and $$\frac{S}{V},$$

$C_z$ T, P, t, and $S_{REs}$.

In step S6, the target formation undergoes acid fracturing without proppant, so $\phi_p$ and $C_p$ are set to 0. Acid solutions (including single gelling acid, in-situ generated acid, cross-linked acid, and diversion acid) are first injected, either as pairwise secondary alternating injections or pairwise tertiary alternating injections, to etch the fractures and form acid-etched fractures with different morphologies. Subsequently, $Na_2HPO_4+H_3PO_4$ is injected to in-situ modify the fracture wall surfaces. Fracture conductivity experiments are then performed before and after in-situ modification to obtain fracture conductivity under different effective closure stresses (5, 10, 20, 30, 40, 50, 60, 70, 80, and 90 MPa). Laser scanning and a micro-Vickers hardness tester are used to measure the fracture wall surface morphology and rock embedment strength before and after modification. Fracture wall surface characteristic parameters (Ra, JRC, $\varepsilon_{cc}$ and $\varepsilon_{cl}$) are calculated using formulas (4) to (6). A model is initially fitted using multivariate nonlinear regression, but the residuals and SSE are too large. Therefore, a correlation model between the fracture conductivity and the rock embedment strength of the fracture wall surfaces, the fracture wall surface characteristic parameters, and the effective closure stress is established using machine learning algorithms (GPR, RF, ANN). According to the evaluation metrics MAE and RMSE, the GPR model is selected to describe the relationship between kwf and $S_{REs}$, Ra, JRC, $\varepsilon_{cc}$, $\varepsilon_{cl}$, and $\sigma_{ce}$. The fracture conductivity test in this step includes the following procedures: (1) the test rock plate is placed in a core holder and connected to inlet and outlet pipelines and a differential pressure sensor; (2) confining pressure is applied, and the displacement pump is opened to purge the pipelines and fill the fracture and pipelines with the test fluid; (3) experimental parameters such as closure stress are set in the control software; (4) after starting the experiment, the hydraulic press automatically applies the set closure stress, the fluid is displaced at a constant flow rate, and in a case where the inlet and outlet pressure difference stabilizes, the program automatically records flow rate, differential pressure, and other data; (5) step 4 is repeated for all closure stress levels, after which the pump is turned off, the hydraulic oil pressure and confining pressure are released, the flow cell and pipelines are disassembled, and the experimental data are exported. The devices used for the above test are conventional core displacement devices.

In step S7, the production capacity model is used to calculate that the fracture conductivity required for reservoir stimulation is 56 $\mu m^2 \cdot cm$. With the fracture closure model, the fracture closure time is calculated as 108 min, t=108 min. Given a reservoir pressure of 87 MPa and a minimum horizontal principal stress of 143 MPa, the effective closure stress of the fracture $\sigma_{ce}$ is 56 MPa. The target formation undergoes acid fracturing without proppant, so $\phi_p$ and $C_p$ are set to 0. Based on the acid-etched fracture wall surface characteristic parameters obtained in step S6, fracture conductivity is calculated under different fracture wall surface morphologies using the acid-etched fracture conductivity formula. The fracture wall surface characteristic parameters corresponding to the maximum conductivity are selected, Ra is 1.22, JRC is 86.7, $\varepsilon_{cc}$ is 1.17, and $\varepsilon_{cl}$ is 1.43. With the GPR model established in step S6, the fracture wall rock embedment strength is inversely designed as $S_{RE}$ is 2561 MPa. Considering a temperature T of 182° C., a pressure P of 87 MPa, a surface-to-volume ratio $$\frac{S}{V} = 250,$$

and the original rock embedment strength $S_{REs}$=1435 MPa, the RF model established in step S5 is used to inversely design the rock strengthening agent concentration as $C_z$=0.26 M.

The above descriptions are only preferred embodiments of the present application, and are not intended to limit the present application in any form. Although the preferred embodiments above have disclosed the present application, they are not intended to limit the present application. Any of those familiar with the technical field, without departing from the scope of the technical solutions of the present application, can use the technical content disclosed above to make various changes and modify the technical content as equivalent changes of the equivalent embodiments. However, any simple modifications, equivalent changes and modifications made to the above embodiments according to the technical spirit of the present application without departing from the content of the technical solutions of the present application shall fall within the scope of the technical solutions of the present application.

What is claimed is:

1. A method for constructing a high-conductivity fracture of carbonate reservoir stimulation, comprising the following steps:

S1: determining a lithology at a target layer as carbonate rock;

S2: theoretically analyzing and primarily selecting a rock strengthening agent for modifying fracture wall surfaces in situ;

S3: performing in-situ modification experiments on the fracture wall surfaces under reservoir conditions by using the rock strengthening agent preliminarily selected in S2, and testing parameters such as rock sample hardness, permeability, mass, and three-dimensional spatial distribution of pores before and after the experiments;

S4: based on the experimental results in S3, selecting a rock strengthening agent corresponding to a maximum comprehensive index Fr;

$$F_r = x\frac{HV_s - HV_o}{HV_o} + \gamma\frac{k_s - k_o}{k_o} + \xi\frac{L_s - \Delta L}{L_s} + \lambda\frac{(m_z - m_o)/t}{\frac{1}{n}\sum_{i=l}^{n}\left[(m_{si} - m_{oi})/t_i\right]} \quad (1)$$

wherein $HV_s$, $k_z$, $L_s$, $m_s$, and $t_i$ respectively represent hardness, permeability, length, mass, and treatment time of the rock sample after treatment with the rock strengthening agent; the subscript i represents an i-th experiment, each rock strengthening agent is tested n times; $HV_o$, $k_o$, and $m_o$ respectively represent hardness, permeability, and mass of an original rock sample; $\Delta L$ is a penetration depth of the rock strengthening agent, obtained from the three-dimensional spatial distribution of pores reconstructed by CT before and after the experiment; and $\chi$, $\gamma$, $\xi$, and $\lambda$ are coefficients, $\chi+\gamma+\xi+\lambda=1$;

S5: performing in-situ modification experiments of the fracture wall surfaces using the rock strengthening agent selected in S4 under different surface-to-volume ratios, rock strengthening agent concentrations, experimental temperatures, pressures, and times, measuring the rock sample hardness before and after the experiments, calculating the rock embedment strength before and after the experiments, and constructing a mathematical model relating the rock embedment strength to the surface-to-volume ratio, the rock strengthening agent concentration, the experimental temperature, the pressure, and the time; wherein a calculation formula for the rock embedment strength is as follows:

$$S_{RE} = \frac{gHV}{\sin\frac{\alpha}{2}} \times 10^6 \quad (2)$$

wherein $S_{RE}$ is the rock embedment strength; g is the acceleration of gravity; HV is the rock sample hardness; $\alpha$ is a relative angle between an indenter of the hardness tester and the surface; the mathematical model relating the rock embedment strength to the surface-to-volume ratio, the rock strengthening agent concentration, the experimental temperature, the pressure, and the time is constructed by using machine learning algorithms or multivariate nonlinear regression;

$$S_{REs} = f\left(\frac{S}{V}, C_z, T, P, t, S_{REo}\right) \quad (3)$$

wherein $S_{RE}$ is the rock embedment strength of the rock sample after treatment with the rock strengthening agent;

$$\frac{S}{V}$$

is a ratio of a reaction area of the rock sample to a volume of the rock strengthening agent participating in the reaction; $C_z$ is a concentration of the rock strengthening agent; T, P, and t are experimental temperature, pressure, and time, respectively; and $S_{REo}$ is a rock embedment strength of the original rock sample;

S6: performing fracture conductivity experiments before and after in-situ modification of the fracture wall surfaces using the rock strengthening agent selected in S4, obtaining fracture wall surface characteristic parameters and rock embedment strength before and after modification, and constructing a mathematical model relating the fracture conductivity to the rock embedment strength of the fracture wall surfaces, fracture morphology, proppant parameters, proppant placement concentration, and effective closure stress using multivariate nonlinear regression or machine learning algorithms, namely:

$$kwf = F(S_{REz}, Ra, JRC, \varepsilon_{cc}, \varepsilon_{cl}, \phi_z, C_p \sigma_{ca}) \quad (4)$$

wherein kwf is the fracture conductivity; Ra is a root mean square elevation; JRC is a roughness coefficient; $\varepsilon_\alpha$ and $\delta_{cl}$ are transverse and longitudinal tortuosity ratios, respectively; $\phi_p$ is a porosity of the proppant placed within the fracture; $C_p$ is the proppant placement concentration; and $\sigma_{ce}$ is the effective closure stress of the fracture; and

S7: calculating the fracture conductivity required for carbonate reservoir stimulation based on the production capacity model, and, combined with reservoir parameters and fracture closure time, inversely designing the rock strengthening agent concentration, the fracture morphology, the proppant parameters, and the proppant placement concentration using the mathematical models established in S6 and S5.

* * * * *